US005147044A

United States Patent [19]

DiSesa, Jr.

[11] Patent Number: 5,147,044

[45] Date of Patent: Sep. 15, 1992

[54] STACKABLE STORAGE CONTAINER

[75] Inventor: Frank J. DiSesa, Jr., Lunenburg, Mass.

[73] Assignee: Tucker Housewares, Inc., Leominster, Mass.

[21] Appl. No.: 699,739

[22] Filed: May 14, 1991

Related U.S. Application Data

[63] Continuation of Ser. No. 480,239, Feb. 15, 1990, Pat. No. 5,038,937.

[51] Int. Cl.[5] ..... B65D 21/02

[52] U.S. Cl. ..... 206/501; 220/255; 220/334; 220/908

[58] Field of Search ..... 206/501; 220/908, 255, 220/334

[56] References Cited

U.S. PATENT DOCUMENTS 3,379,341 6/1967 Miles .
3,512,696 4/1968 Ebert .
3,860,309 1/1975 Brendgord .
4,523,692 6/1985 Lemkin .
4,588,086 5/1986 Coe .
4,718,552 1/1988 Rossi et al. .
4,767,003 8/1988 Rice et al. .
5,022,548 6/1991 Stakis ..... 206/501

FOREIGN PATENT DOCUMENTS 1401306 4/1965 France .

*Primary Examiner*—Moy: Joseph Man-Fu
*Attorney, Agent, or Firm*—Darby & Darby

[57] ABSTRACT

A stackable container has an open top and a substantially open front defined by a flange, with a transparent cover securable over the front opening to allow viewing of the contents of the container. The container has a removable lid with formed structures for stacking additional containers thereon, with the cover hinged from the lid. The container also has strengthening ribs which are incorporated in the sides and back of the container, with the ribs providing complementary recesses for nesting the containers when empty.

8 Claims, 4 Drawing Sheets

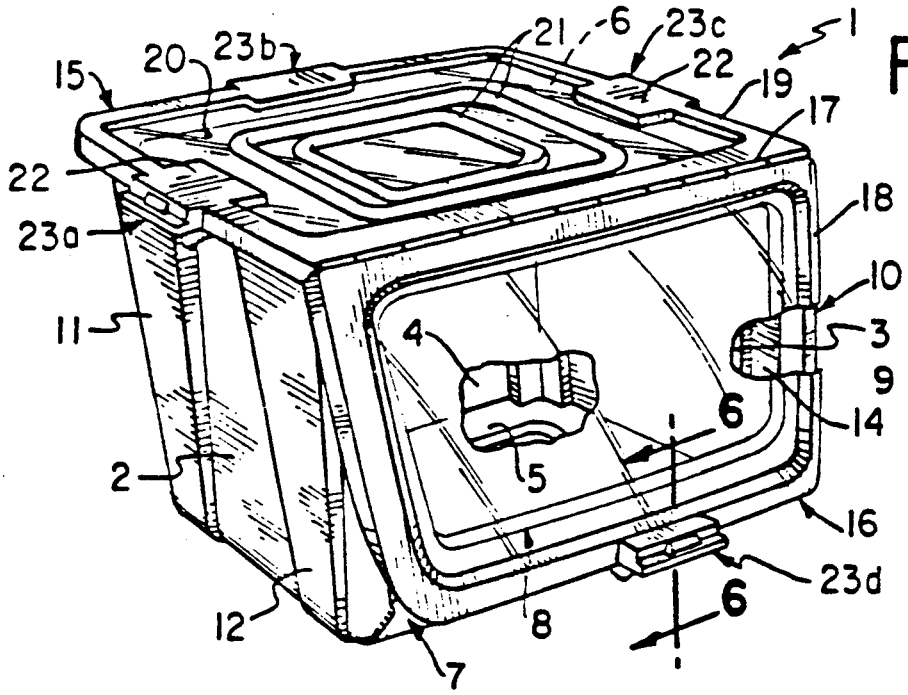
FIG. 1
FIG. 2
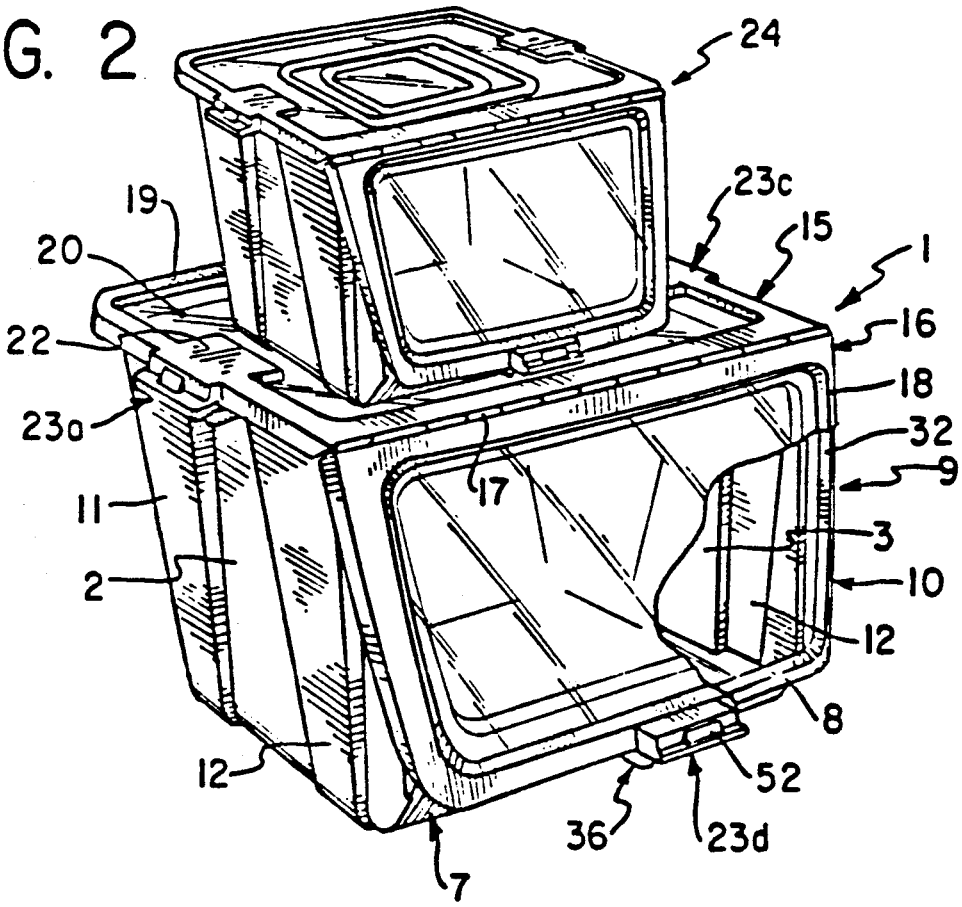

STACKABLE STORAGE CONTAINER

This is a continuation of application Ser. No. 480,239, filed Feb. 15, 1990, now U.S. Pat. No. 5,038,937.

TECHNICAL FIELD

The invention relates to storage containers, and more particularly to a stackable storage container, which allows inspection of and access to the contents of the container when stacked.

BACKGROUND OF THE INVENTION

Stackable containers are known in the art for holding various materials. These are typically rectangularly shaped, having either an open top with formed structures for supporting an identical container above it or an open top with a removable lid, the lid of sufficient strength for supporting another container. Typically, when these containers are stacked, they do not provide ease of entry into the container to retrieve or to insert articles. Consequently, such containers have to be unstacked to access the container contents. Also, when stacked, the containers do not allow inspection of the stored articles to determine which articles are stored within a particular container.

SUMMARY OF THE INVENTION

It is an object of the present invention to provide a stackable container which provides access to articles stored in the stacked containers without unstacking.

It is a further object of the present invention to provide a stackable container with means for inspecting the stored articles within the container without opening or unstacking the container.

It is yet another object of the present invention to provide a stackable container which includes a separate lid having integrally formed means for locking the lid on the container.

It is yet another object of the present invention to provide a stackable container which is lightweight, and has integrally formed handles for gripping and moving the container.

It is yet another object of the present invention to provide a stackable container which is nestable for shipping and storage.

These and other objects of the present invention are achieved by providing a stackable container comprising a container body, having an open top and a substantially open front, a container flange forming a border around the open top and open front. A removable lid is provided which is sized to fit the open top, the lid having a mating flange defining its periphery for receiving the top portion of the container flange. A front cover is hinged to the lid, and sized to cover the substantially open front, and also has a mating flange for receiving the front portion of the container flange. The front cover is preferably transparent and disposed at an angle relative to the lid. The container preferably has at least two locking handles for locking the lid and/or front cover to the container.

BRIEF DESCRIPTION OF THE DRAWINGS

FIG. 1 is a perspective view of a stackable container of the present invention.

FIG. 2 is a perspective view of a pair of stacked containers of the present invention.

DETAILED DESCRIPTION OF THE PREFERRED EMBODIMENT

Figure 3:
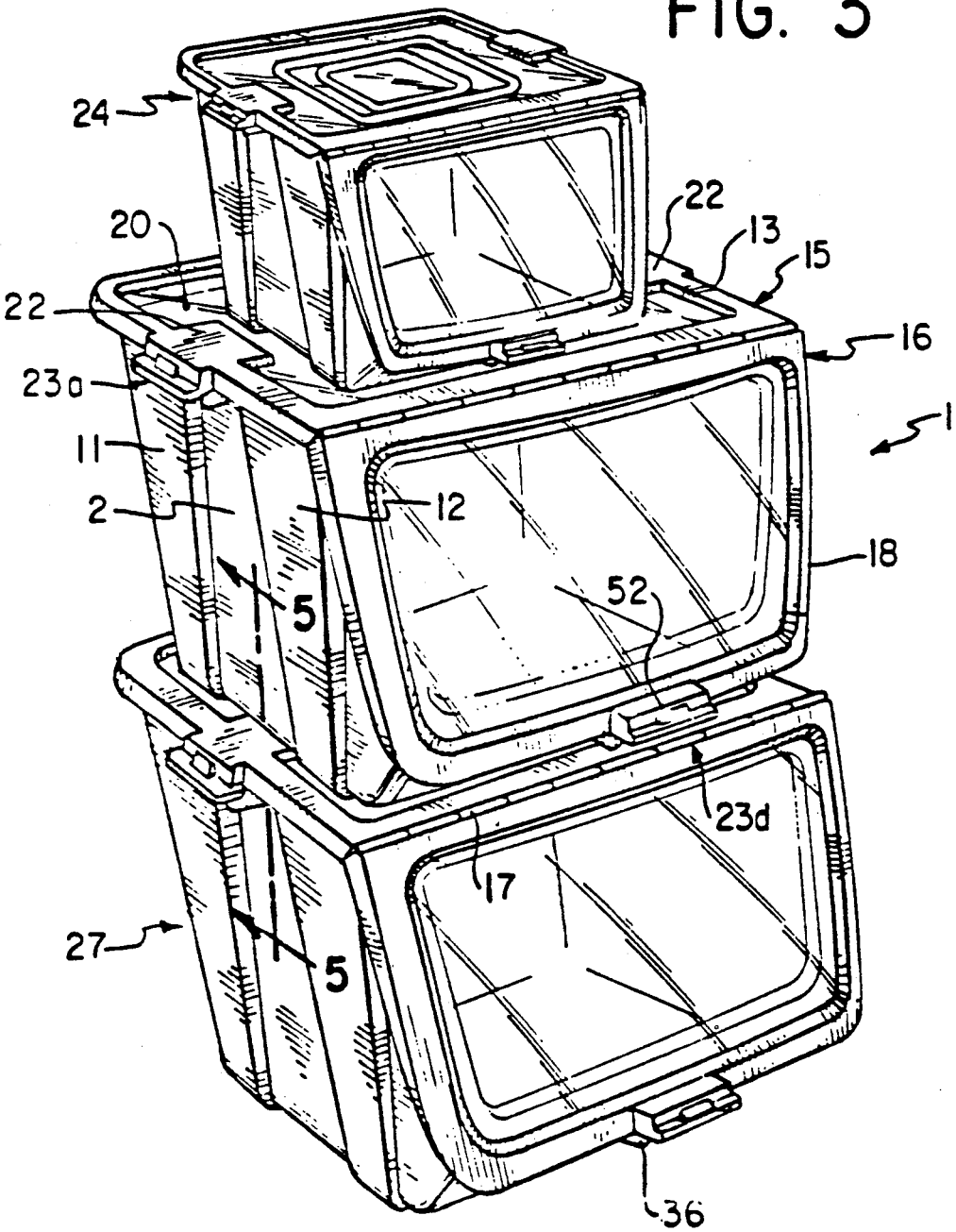
FIG. 3 is a perspective view showing three stacked containers.

Referring to FIG. 1, a stackable container 1 is shown having sides 2 and 3, a back 4, a bottom 5, and an open top 6, with the sides and back tapering downwardly to the bottom. The container includes front face 7 which defines a front opening 9 in the container. A continuous flange 10 extends around both the top and front openings in the container. The container 1 includes tapered strengthening sidewall ribs 11 and 12. These ribs add stiffness to the container. The ribs 11 and 12 also provide corresponding indentations within the container which act as guides for nesting the containers for compact storage when empty, the ribs of one container fitting within the indentations provided by the ribs of another container.

A lid 15 is disposed over the open top 6 on the container, with a cover 16 attached by a hinge 17 to the lid 15 disposed over the front opening 9. The cover and lid both have flanges 18 and 19, respectively, for receiving the respective portions of the flange 10 therein, preferably with a snug fit. The lid 15 has a recessed planar surface 20 and ridges 21 which add strength to the lid and provide support for stacking containers. By properly tapering the sides and back, the planar surface becomes larger than the bottom. Therefore, the surface may be sized and shaped to support another container having a similarly sized bottom. In addition, the lid has raised tabs 22 which extend from the flange 19 onto the planar surface for increasing the stability of a stacked container, by interacting with the strengthening ribs of the stacked container. Both the lid and cover may be transparent to allow viewing of the contents of the container. However, only the cover 16 need be transparent, the lid 15 possibly being opaque.

The lid 15 and cover 16 are lockable onto the container by means of locking handles. The container in FIG. 1 has four locking handles, three handles **23*a*, 23*b*, and 23*c* for locking the lid and one handle 23*d*** for locking the cover.

FIG. 2 illustrates the stacking of a small container 24 on the larger container 1. FIG. 3 illustrates the stacking of the small container 24 on the container which is in turn stacked 1 on a similarly sized container 25.

Figure 4:
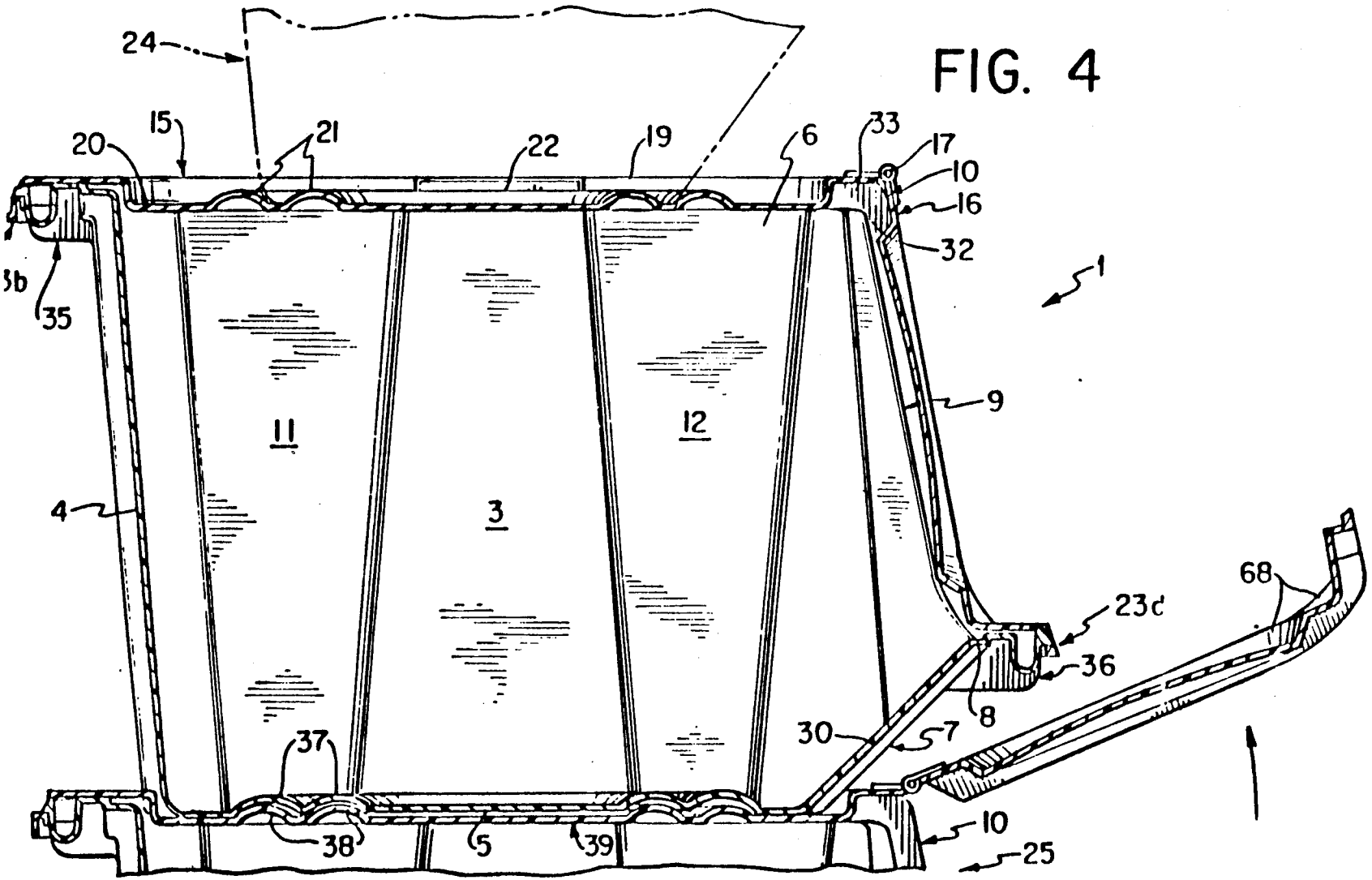
FIG. 4 is a cross sectional view of the stacked containers of FIG. 3.

Referring to FIG. 4, a cross sectional view of the stacked containers of FIG. 3 is shown. The front face 7 of container 1 includes a lower, forwardly extending portion 30 which extends from the bottom 5, preferably at an angle of about 120 degrees, which mates with a flange portion 32 extending from a top flange portion 33, preferably at an angle of from about 90 to 120 degrees. The front opening 9 is defined by the flange portion 32 and generally comprises about 50% of the front surface of the container. Of course, the opening size may vary with the type of container. The container also includes locking handles 35 and 36.

The bottom 5 of the container has ridges 37 which are complementary to ridges 38 on a lid 39 of the lower container 25. Consequently, when stacked, the ridges on the bottom of one container interact with the corresponding ridges on the adjacent lid of another container to ensure stability of the stacked containers. Notice that the smallest container 24 sits on a recessed planar surface 20 of the lid 15 and relies on ridges 21 for stability, while the container bottom 5 relies for stability on the ridges 38, with the raised tabs 40 containing and defining the stacking area on the lid 39.

The container of the present invention is preferably composed of a moldable plastic material such as polyethylene, or polypropylene. The front cover of the container is preferably composed of a transparent material to allow viewing of the contents of the container. The lid may also be made of a transparent material. Also, the lid and cover should be somewhat resilient for improving sealing. The advantage to having such a large front opening is to have easy access to the container contents, and to allow viewing of the container interior without unstacking or opening the container.

The cover may be hinged to the lid using a separate rod insertable through a plurality of interleaved cylindrical openings. Such a configuration allows making the front lid of a different material than the top lid. Of course, a unitary molded structure with a resilient seam for acting as the hinge could also be used with the present invention, or a molded-in hinge arrangement wherein the lid snaps into the cover.

Figure 5:
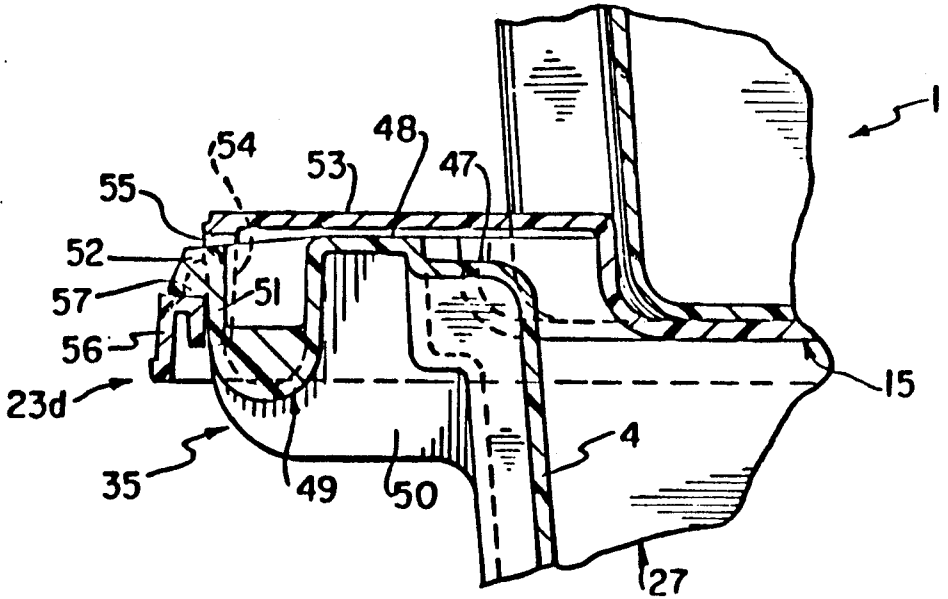
FIG. 5 is an enlarged cross sectional view of a lid-locking handle of the present invention, taken along the line 5—5 of FIG. 3.
Figure 6:
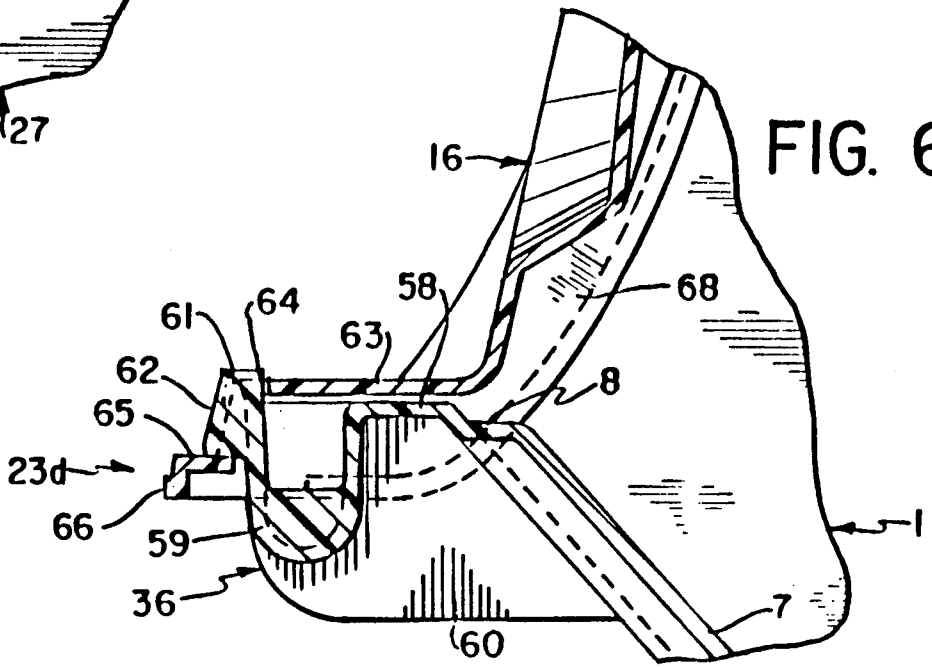
FIG. 6 is an enlarged cross sectional view of a cover-locking handle of the present invention, taken along the line 6—6 of FIG. 1.

Referring to FIGS. 5 and 6, enlarged views of the locking handles 35 and 36 incorporated in the container of the present invention are shown. The container back 4 includes a first extending portion 47 which extends perpendicular to the wall 4, then adjoining to a gripping portion 48 which is connected to a downwardly extending curved projection 49. A pair of sidewalls 50 provide end boundaries with the space between the wall 46, the projection 49 and the sidewalls 50 defining a pocket for gripping the container and thus forms the handle for the container. The projection 49 also includes an upwardly extending portion 51 which gives the projection a U-shape. The portion 51 has a first forward then downwardly extending angled lip 52. To complete the lock, the lid 15 has a first extending portion 53, and then a downwardly extending portion 54 within which an opening 55 is provided. An essentially U-shaped leg 56 extends from the downwardly extending portion 54 in order to provide means for unlocking the lid. The U-shaped leg 56 includes an essentially flat surface 57 upon which the lip 52 rests when in the locked position. The angled portion of the lip 52 is angled such that the opening 55 may be snapped down over the lip 52 until the lip seats in the opening. By pulling the leg 56 away from the lip 52, the angled portion of the lip is disengaged from the opening, allowing the lid to be removed.

Referring to FIG. 6, a similar locking handle 36 is used to lock the cover 16 to the container 1. Here, the container includes a forwardly extending portion 58 which mates with projection 59 which is preferably U-shaped and has sidewalls 60, with the space between the portion 58 and the projection 59 defining a pocket for lifting the container, and a forwardly extending lip 61 is provided with a front angled surface 62. The cover includes a forwardly extending portion 63 which has an opening 64 within which the lip 61 is mateable for seating. A flat surface 65 is provided in an outwardly extending projection 66, the projection 66 providing a means for gripping the cover portion of the locking handle, which can be pulled forward and resiliently disengaged from the lip of the container to allow opening of the cover. FIG. 4 shows a cover in the open position, illustrating the flange 10 and the cover mating flange 68.

While tapered strengthening ribs, ridges and other formed structures are used for supporting the stacked containers, it will be understood that various other shapes could be used with the container of the present invention. In addition, while four handles are shown on an individual container, it will be understood that the number of handles required for a particular container is dependent on the application to which it will be put and, thus, any number of locking handles can be included in a container. For example, the container 24 includes only 3 locking handles.

It should also be understood that the sizes and shapes of the container are relative and that many different sized containers could be stacked or provided depending on the needs of the user.

We claim:

1. A stackable container comprising:

a molded plastic container body having bottom, back and side walls joined to form an open top and an open front, each of said sidewalls having a front section with exposed front edges sloping downwardly from the top thereof to define a downwardly sloping front opening, an extension piece angled upwardly from the front end of the bottom wall intersecting the downwardly sloping side wall front sections front edges, the top edge of the extension piece defining the bottom edge of the downwardly sloping front opening, a continuous flange forming a border abound the edges of the back and side walls forming the open top and bottom wall of the upwardly angled extension piece forming the open front, a removable lid, sized to cover the open top and having a mating flange defining its periphery, the lid mating flange having a recess sized to accept the back and side wall continuous flange, a front cover hingedly attached at one end to the lid, the front cover sized to cover the body front opening and having a mating flange sized to accept the side wall front and bottom wall extension piece of the container body flange therein.

2. A container as in claim 1 wherein the front cover is transparent.

3. A container as in claim 1 wherein the lid is opaque and the front cover is transparent.

4. A container as in claim 1 further comprising first mating locking means on the bottom edge of the cover and the top edge of the bottom wall extension.

5. A container as in claim 4 further comprising handle means on said bottom edge of said cover in the area of said first mating locking means.

6. A container as in claim 1 further comprising second mating locking means on said lid and the upper edge of at least one side wall.

7. A container as in claim 1 wherein the lid and the cover are each of a different material.

8. A container as in claim 1 wherein each said side wall front section is spaced inwardly of the next adjacent portion of its side wall toward the back of the container.

* * * * *